US012291933B2

(12) United States Patent
Mussi Baptista et al.

(10) Patent No.: US 12,291,933 B2
(45) Date of Patent: May 6, 2025

(54) METHOD FOR CLEARING FLEXIBLE LINES USING COILED TUBING FROM A WELL INTERVENTION RIG

(71) Applicant: Petróleo Brasileiro S.A.—Petrobras, Rio de Janeiro (BR)

(72) Inventors: João Marcelo Mussi Baptista, Rio de Janeiro (BR); Paulo Igor Barbosa Martins, Rio de Janeiro (BR); Rossano Renir Comunelo, Florianópolis (BR); Andre Luiz Bevilaqua Santana, Macaé (BR); George Souza Costa, Rio de Janeiro (BR); Carlos Alberto Teles Borges, Macaé (BR); Julio Maia Gouvea, Niterói (BR); Fernando Koiti Higashi Nakashima, Ribeirão Preto (BR); Ana Karla Melle Soares, Rio de Janeiro (BR); Paulo Tavares Fernandes, Rio de Janeiro (BR); Anderson Meireles Palmeira, Rio de Janeiro (BR); Nilton de Lima França, Macaé (BR); Jose Augusto Pinto Padilha, Rio de Janeiro (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 294 days.

(21) Appl. No.: 17/782,810

(22) PCT Filed: Dec. 2, 2020

(86) PCT No.: PCT/BR2020/050511
§ 371 (c)(1),
(2) Date: Jun. 6, 2022

(87) PCT Pub. No.: WO2021/108880
PCT Pub. Date: Jun. 10, 2021

(65) Prior Publication Data
US 2023/0349244 A1 Nov. 2, 2023

(30) Foreign Application Priority Data
Dec. 5, 2019 (BR) ..... 10 2019 025811 0

(51) Int. Cl.
*E21B 19/22* (2006.01)
*B63B 21/50* (2006.01)
*E21B 37/00* (2006.01)

(52) U.S. Cl.
CPC ..... *E21B 19/22* (2013.01); *B63B 21/50* (2013.01); *E21B 37/00* (2013.01)

(58) Field of Classification Search
CPC ..... E21B 19/22; E21B 37/00; E21B 41/0007
See application file for complete search history.

(56) References Cited

U.S. PATENT DOCUMENTS

2003/0106714 A1* 6/2003 Smith ..... E21B 19/22 114/244
2005/0284504 A1 12/2005 Kinnari et al.
(Continued)

FOREIGN PATENT DOCUMENTS

| | | | |
|---|---|---|---|
| BR | PI0817188 | A2 | 3/2015 |
| EP | 1794408 | B1 | 5/2008 |
| WO | 2004053935 | A2 | 6/2004 |
| WO | 2009042319 | A1 | 4/2009 |
| WO | 2017135941 | A1 | 8/2017 |

*Primary Examiner* — Matthew R Buck
(74) *Attorney, Agent, or Firm* — Mintz, Levin, Cohn, Ferris, Glovsky and Popeo, P.C.

(57) ABSTRACT

The present invention addresses to a method of clearing submarine pipes, in which the method solves the most complex cases of obstruction of flexible submarine pipes, where the conventional approach is ineffective. Additionally, the present invention represents a cheaper alternative to the clearance of pipes in scenarios where the conventional approach is applicable. The method of clearing flexible pipes using flexitube from a well intervention rig of the present invention comprises as one of its main steps: with the aid of a remotely operated vehicle (51), opening a flanged connec-
(Continued)

tion (10) between two flanges (15) of the legs (12 and 14) of a submarine pipe (40) and installing a pull head (16 and 17) in each of these legs (12 and 14); and using well intervention rig (120) operations; assembling the hoisting assembly (58) for hoisting the leg (14) of the submarine pipe (40) with the drill string (50); hoisting the leg (14) of the submarine pipe (40) through its end using the hoisting assembly (58) coupled to the pull head (16); draining the internal pressure of the pipe by means of the connection of a tube (67) with the pull head (16); assembling the Surface Flow Tree (70) at the end of the leg (14) of the submarine pipe (40), using the connection adaptation parts (90) and (91) to make the end of the leg compatible with the Surface Flow Tree; assembling the Flexitube (80) on the Surface Flow Tree (70) and surface lines (72); carrying out the operation of clearing the leg (14) of the submarine pipe (40) with Flexitube (80).

5 Claims, 5 Drawing Sheets

(56) References Cited

U.S. PATENT DOCUMENTS

| | | | |
|---|---|---|---|
| 2008/0067129 | A1 | 3/2008 | Juenke et al. |
| 2010/0018693 | A1 | 1/2010 | Duncan et al. |
| 2018/0043401 | A1* | 2/2018 | MacKenzie ..... B08B 9/0321 |

* cited by examiner

METHOD FOR CLEARING FLEXIBLE LINES USING COILED TUBING FROM A WELL INTERVENTION RIG

CROSS-REFERENCE TO RELATED APPLICATIONS

This application is a national phase application, filed under 35 U.S.C. § 371, of PCT International Patent Application No. PCT/BR2020/050511, filed Dec. 2, 2020, and claims benefit of and priority to Brazilian application BR 10 2019 025811 0, filed on Dec. 5, 2019, the disclosures of all of which are incorporated herein by reference in their entirety.

FIELD OF THE INVENTION

The present invention addresses to solutions for more complex cases of obstruction of flexible submarine pipes where the conventionally applied approach is ineffective. Additionally, the present invention provides a lower cost alternative for clearing said flexible submarine pipes.

DESCRIPTION OF THE STATE OF THE ART

Production pipe obstructions are quite common in the oil industry, and can occur due to several causes; among the most frequent, there are the formation of hydrates and paraffins, scaling, and the deposit of solids and debris.

Depending on the nature and severity of the obstruction, it can be resolved by carrying out operations from the production unit itself, which implies lower costs when compared to interventions with a rig.

Some examples of these operations would be, in increasing order of costs, the passage of a pig through the clogged pipe, cycles of pressurization and depressurization of the pipe, and descending a flexitube inside the submarine pipe from the production platform.

However, it is common to have cases in which the clearing of the submarine pipe by means of the production platform is unfeasible, wherein the most typical scenario is the one where the production and service (annular) pipes are clogged with hydrates.

In this scenario, the production platform is not able to apply low pressures in the deepest sections of the pipes to dissociate the hydrate, requiring an intervention with a rig that, conventionally, consists of the following steps:

a) recovery of the corrosion cap;
b) preparation of submarine tools-TRT (Intervention Tool of Christmas Tree), BOPW (Safety Equipment of Wellhead) and FIBOP (Quick Disconnect Tool);
c) removal of the Christmas tree cap (Tree Cap); d) descent of the completion riser, or drill pipe riser (DPR);
e) filling the completion riser with nitrogen;
f) connection of submarine tools to the WCT (Wet Christmas Tree);
g) WCT tests;
h) operations with wire (slick line) to gauge the production string and laying the BRV (valve to block the well surge);
i) filling the production string with nitrogen;
j) depressurization of the production string plus the completion riser;
k) opening of the side valves of the WCT and hydraulic communication of the obstructed submarine pipe with the interior of the completion riser string and production string and waiting for the production string plus the completion riser to be filled with the liquid from the dissociation of the hydrate;
l) repetition of steps 9, 10 and 11 until the submarine pipe is cleared.

However, this conventional intervention can last from 15 days to more than 100 days (extreme cases), and a typical average duration of 30 days can be considered. In addition, it must be taken into account that submarine tools for connection to the WCT are generally not immediately available, which delays the return to production. In addition, the conventional rig intervention approach works well to remove hydrates, but may be ineffective for obstructions of another nature, where it is not enough to depressurize the pipe to clear it, but mechanically act on the obstruction to remove the same.

Document BRPI0817188A2 discloses a hydrocarbon production system with a method for controlling hydrate formation in a submarine production system. The document further discloses a method comprising steps of depressurizing the production line to substantially reduce a concentration of gas in solution in the produced hydrocarbon fluids and then repressurizing the production line to urge any remaining gas in the free gas phase into the production line from the production line back to the solution. Further, the method includes displacing production fluids within the production line by moving displacement fluids from a service line into the umbilical line and the production line. The displacement fluids preferably comprise a hydrocarbon-based fluid having a low dose hydrate inhibitor (LDHI).

Document US20100018693A1 discloses an apparatus for inserting a flexitube into submarine pipes during, for example, hydrate remediation activity, which comprises a curved guide for guiding the flexitube in vertical orientation, at the inlet end, for horizontal orientation, or near-horizontal, at the exit end, wherein the adapter allows the vertical position of the exit end of the curved guide to be adjusted for a specific situation, preventing misalignment without the use of sharp bends in a transition element, allowing the flexitube to move smoothly along the transition element, reducing friction between the flexitube and the transition element.

Document WO2004053935A2 discloses an apparatus for umbilical that comprises electrically heated composite umbilical, installed inside a submarine flow line for the transport of produced hydrocarbons, in which the heater has the function of preventing the formation of hydrates in the line.

Document US20080067129A1 discloses a method for treating a piping system for hydrocarbons useful to inhibit paraffin deposition which involves the injection of a catalyst fluid and the induction of the electromagnetic field in hydrocarbons carried by the piping system.

Document EP1794408B1 discloses a method for removing hydrate plugs from a pipe, comprising the following steps: inserting an impeller pig into the piping that has a return flow line connected, advancing the pig forward in the piping, pumping a propulsion fluid into a ring between the oil pipeline and the return flow line while continuously or intermittently removing deposits and returning flow as appropriate from the front of the pig through the return flow line.

WO2017135941A1 discloses a hydrate blockage remediation skid adapted to be assembled on a remotely operated vehicle (ROV) and used to effectively remove blockages from a submarine flow line and submarine equipment. Its system ensures pressure reduction on an upstream side of the blockage so as to create a differential pressure across the blockage with higher pressure present on a downstream side of the blockage to force the blockage through a manifold and into a separator vessel on the flow line remediation skid.

However, as will be seen later, none of the mentioned documents presents the method of clearing flexible pipes using flexitube from a well intervention rig of the present invention.

BRIEF DESCRIPTION OF DRAWINGS

The present invention will be described in more detail below, with reference to the attached figures illustrating an example of embodiment not limiting the scope of the invention, in which.

DETAILED DESCRIPTION OF THE INVENTION

Figure 1:
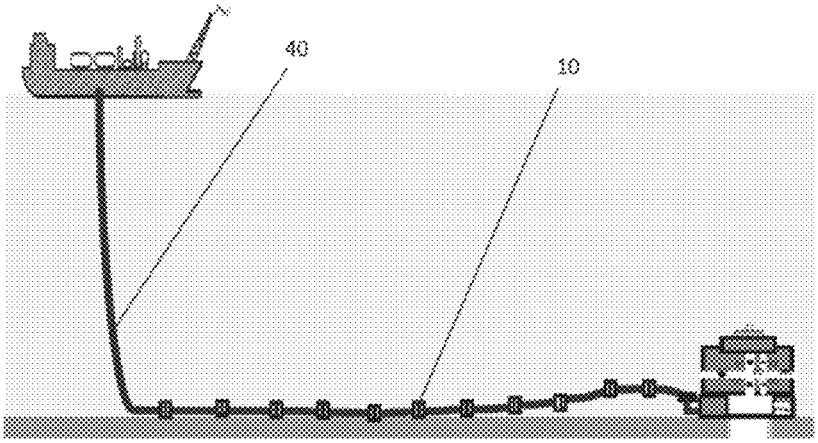
FIG. 1 illustrates an initial condition in which the submarine pipe is coupled between an FPSO and a well.
Figure 2:
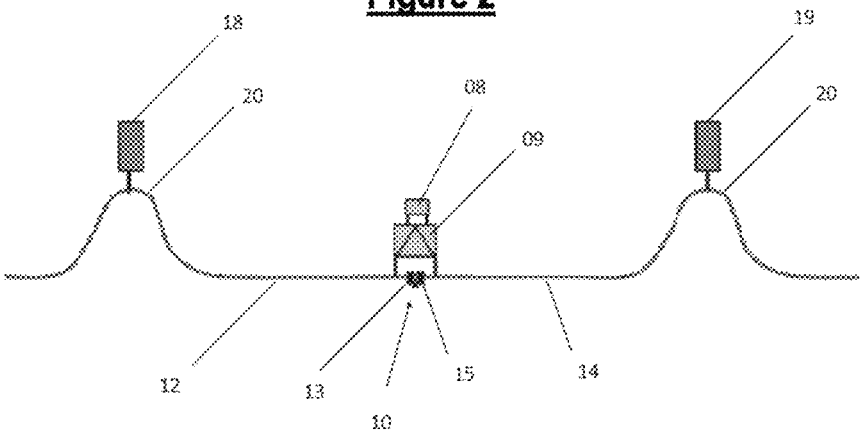
FIG. 2 illustrates a step of the method of the present invention, in which an arrangement for opening a submarine connection between legs of the submarine pipe is illustrated.
Figure 3:
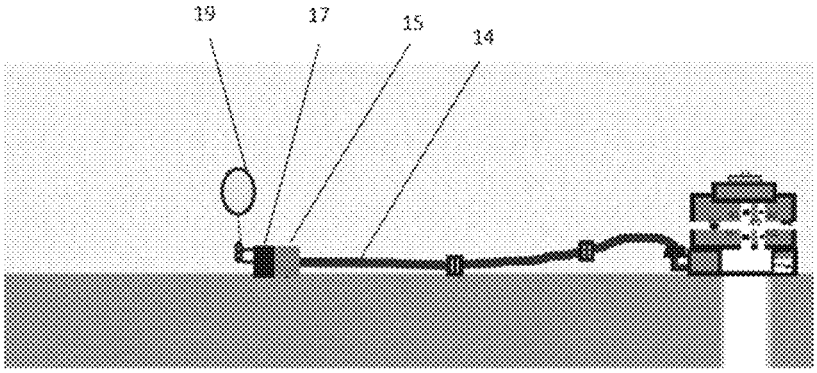
FIG. 3 illustrates one of the steps of the method of the present invention, illustrating only one of the legs coupled to the well.
Figure 4:
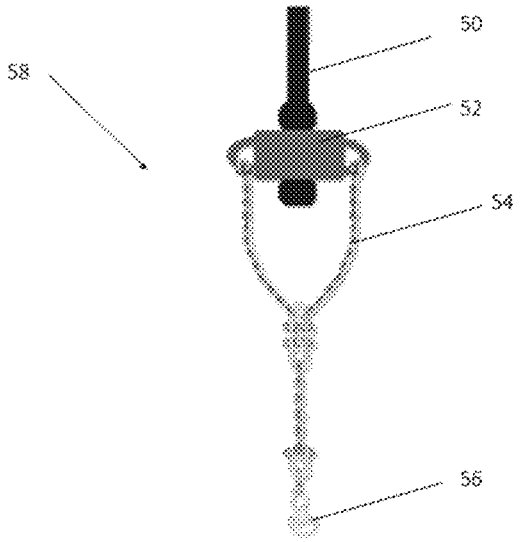
FIG. 4 illustrates one of the steps of the method of the present invention, in which the collection of the obstructed flexible pipe with a rig is illustrated.
Figure 5:
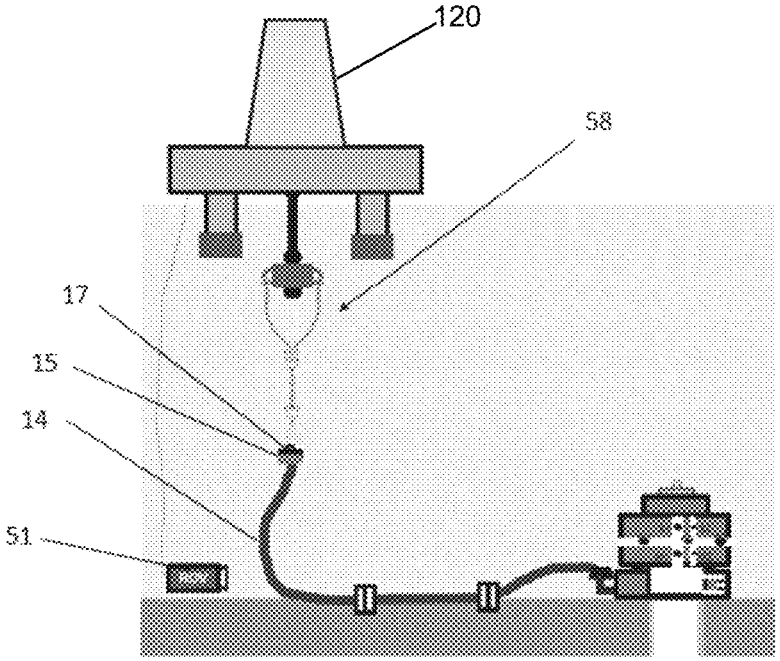
FIG. 5 illustrates in detail the flexible pipe hoisting assembly of the present invention.
Figure 6:
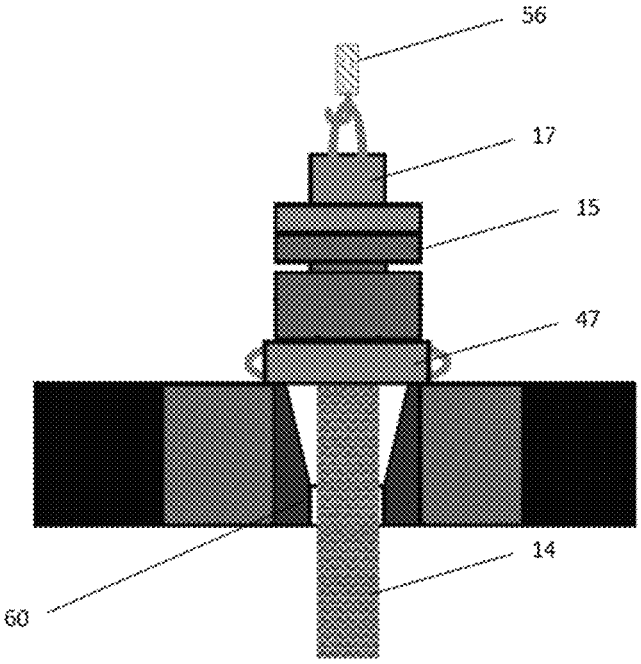
FIG. 6 illustrates in detail the anchoring of the submarine pipe on the rotary table of the rig using a side door elevator.
Figure 7:
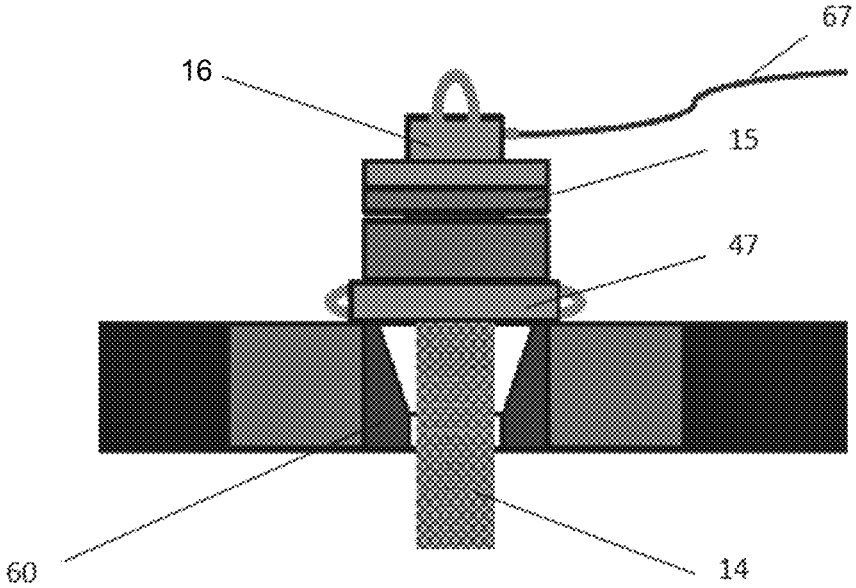
FIG. 7 illustrates the connection of a cable to the pull head.

The present invention comprises a method of clearing flexible pipes using flexitube from a well intervention rig comprising the following steps:

a. opening a flanged connection (10) between two flanges (13 and 15) of two legs (12 and 14) of a submarine pipe (40) and installing a pull head (16 and 17) in each of these legs (12 and 14), in which the step of opening the flanged connection (10) and installing the pull heads (16 and 17) is preferably carried out by an ROV, and comprises the attachment of floats (18 and 19) in each of the legs (12 and 14), so that each leg (12 and 14) has a curved section towards the surface, like a hump (20), thus limiting the volume of oil possible to leak. Additionally, a hood (08) and a shuttle tank (09) can be used, which will serve to prevent any leakage of oily fluid from the pipe to the marine environment;

b. moving a rig (120) to the georeferenced place where the end of the pipe to be recovered by the surface is abandoned;

c. assembling the hoisting assembly (58) for hoisting the leg (14) of submarine pipe (40) with the drill string (50), wherein the hoisting assembly (58) preferably comprises a drill pipe elevator (47) assembled on inverted, "upside down" position (supported over the drill pipe connection) (52) attached to a drill string (50), and attached to this inverted drill pipe elevator (52), anchor ties (54) comprising a hook (56);

d. descending the drill string (50) with the hoisting assembly (58) and engage the hook (56) to the pull head (17) with the aid of an ROV;

e. hoisting the leg (14) of the submarine pipe (40) through its end using the hoisting assembly (58) coupled to the pull head (16);

f. anchoring the end of the leg (14) of the submarine pipe (40) on the rotary table (60) of the rig (120) using a side door elevator (47); this anchorage is obtained by the geometric interference between the elevator collar and the end fitting of the flexible line; once installed, the collar is simply supported on the rotary table;

g. draining the internal pressure of the pipe by means of the connection of a tube (67) preferably comprising a JIC-8 connection with the pull head (16);

h. disconnecting the pull head (17) and assembling the Surface Flow Tree (70) at the end of the leg (14) of the submarine pipe (40), and if necessary, connection adapters (90) and (91) to match the end of the leg with the Surface Flow Tree;

i. assembling the Flexitube (101) on the Surface Flow Tree (70) and surface lines (105 and 106);

j. carrying out the operation of clearing the leg (14) of the submarine pipe (40) with Flexitube (101), where a liquid is pumped through the interior of the flexitube (for example, diesel), which has the power to solubilize the obstruction, or which has the mechanical power to remove the obstruction;

k. cleaning the leg (14) of the submarine pipe (40) with high flow rate seawater circulation, until seawater returns with an oil content within the accepted environmental standards for disposal at the sea;

l. disassembling the Flexitube (101), surface lines (105 and 106) and Surface Flow Tree (70) pieces of equipment;

m. installing the pull head (16) at the end of the leg (14) of the cleared submarine pipe (40), assembling the hoisting assembly (58) for hoisting the leg (14) of the submarine pipe (40) with the drill string (50), and descending the leg (14) of the submarine pipe (40) to the seabed, where the leg (12) of the submarine pipe (40) is located;

n. removing the pull heads (16 and 17) from the legs (12 and 14) of the submarine pipe (40) and connecting the legs (12 and 14) via the flanged connection (10).

At the end of the execution of the steps a-m described above, if necessary, relocate the submarine pipe to bring the ends of the clean leg closer to the leg that was abandoned on the seabed; and The flanged connection (10) is the junction of two legs (12 and 14), in which each leg comprises at its end a flange (15).

Figure 8:
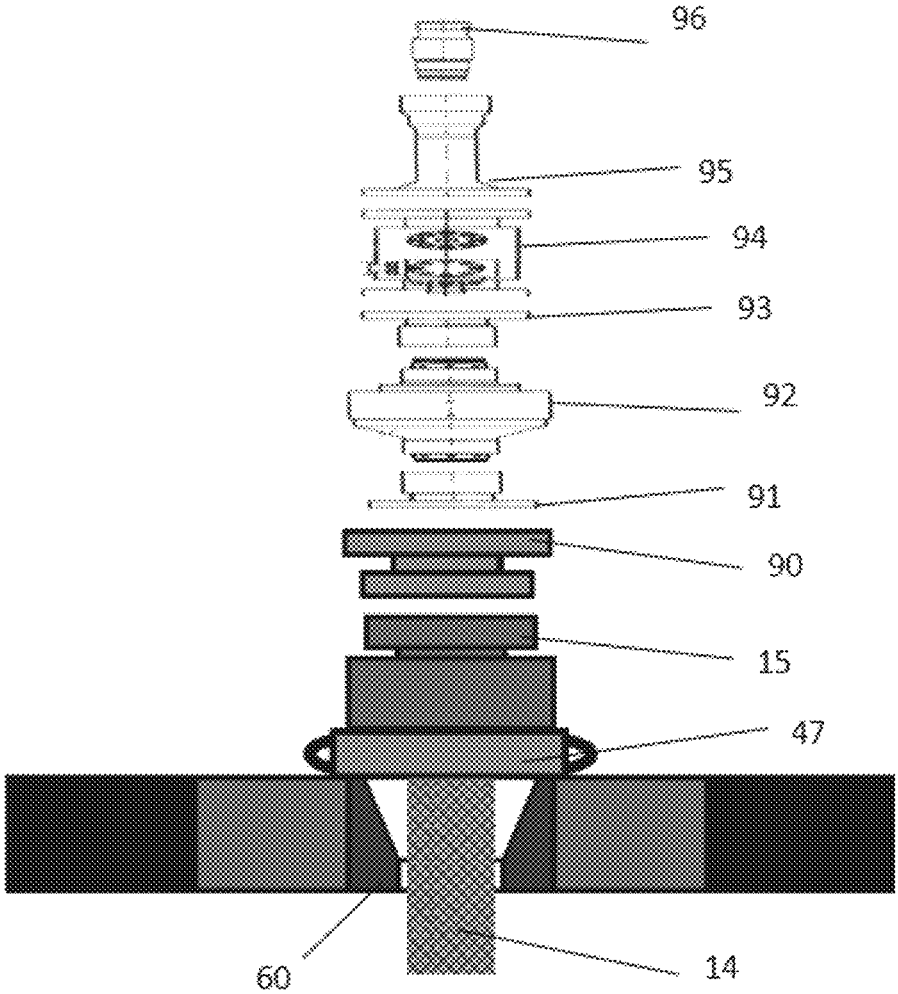
FIG. 8 illustrates the assembly of the surface flow tree on the end of the submarine pipe.

As can be seen in FIG. 8, this illustrates an exploded view of the surface flow tree (70), where its main components can be observed. The hoisted leg of the production tube (14) is anchored to the rotary table, its flanged end (15) resting on an elevator used for hoisting well casings (47), known as a side door elevator. A transition flange (90) is connected on the flanged end of the production pipe (15), to make the production leg flange compatible with the surface flow tree flange, and above this transition flange, there is connected another transition piece (91) of flange connection for the base connection of the surface flow tree (generally 8¼" BUTTRESS), to next connect the surface flow tree itself, which consists of the accessories (92), (93), (94), (95), (96) that are already pre-assembled in the base of the manufacturer of the same.

Figure 9:
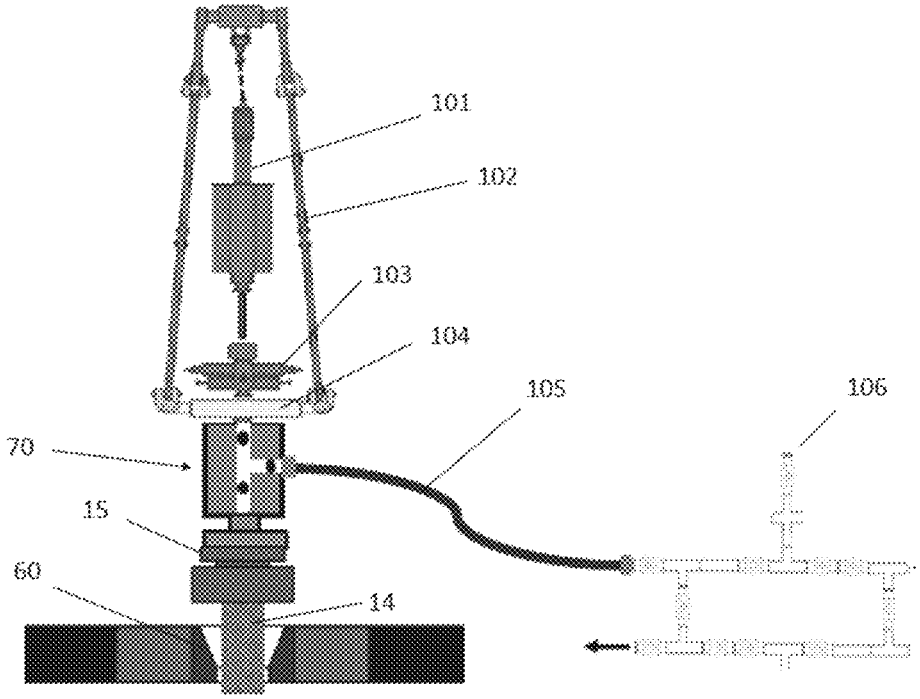
FIG. 9 illustrates a layout of surface assembled pieces of equipment.
Figure 10:
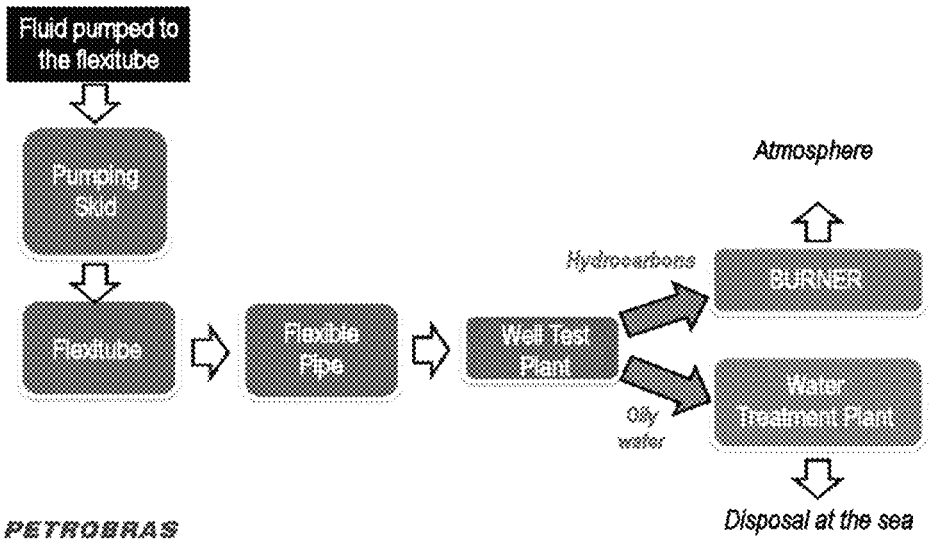
FIG. 10 illustrates a flowchart of the method of the present invention, showing the flow traveled by the fluid that is pumped through the flexitube. The fluid is pumped into the flexitube using a standard pump unit, exits through the end of the flexitube, returns to the rig through the annular space between the flexitube and the production pipe, arrives at the surface flow tree and is diverted to a well test plant, where the hydrocarbons are separated from the water in the water treatment plant, wherein the clean water is discharged into the sea and the hydrocarbons burned to the atmosphere.

FIG. 9 illustrates a layout of surface assembled pieces of equipment, where it is possible to identify the flexitube injector (101), articulated lines (102), BOP (103), extended arms elevator (104), hose (105), manifold (106), surface flow tree (70), production pipe (15), leg (14) and rotary table (60).

Compared to the conventional approach, the present invention brings some advantages, such as not needing to use submarine tools for intervention in the WCT or completion risers (or DPR), which reduces the time of resource mobilization and eliminates time of rig spent in the preparation and descent steps of these tools, which lasts an average of 7 to 10 days, still allows to act mechanically directly on the obstruction, which can be more efficient than the indirect action by pressurizations and depressurizations and allows to remove more complex obstructions that cannot be removed by the conventional approach.

The invention claimed is:

1. A method of clearing flexible pipes using flexitube from an intervention rig in wells, the method comprises the following steps:

a. opening a flanged connection (10) at a location between two flanges (13 and 15) of two legs (12 and 14) of a submarine pipe (40) and installing a pull head (16 and 17) in each of these legs (12 and 14), in which the step of opening the flanged connection (10) and installing the pull heads (16 and 17) comprises attaching floats (18 and 19) in each of the legs (12 and 14), so that each leg (12 and 14) has a curved section towards a surface of a body of water, wherein a hood (08) and shuttle tank (09) to collect oily fluid are used in case of leakage;

b. moving a rig (120) to the location;

c. assembling a hoisting assembly (58) for hoisting the leg (14) of the submarine pipe (40) with a drill string (50);

d. descending the drill string (50) with the hoisting assembly (58) and engage a hook (56) to the pull head (17);

e. hoisting the leg (14) of the submarine pipe (40) through an end of the leg using the hoisting assembly (58) coupled to the pull head (16);

f. anchoring the end of the leg (14) of the submarine pipe (40) on a rotary table (60) of the rig (120) using a side door elevator (47);

g. draining an internal pressure of the pipe by means of a connection of a tube (67);

h. disconnecting the pull head (17) and assembling a Surface Flow Tree (70) at the end of the leg (14) of the submarine pipe (40), and optionally to connection adapters (90) and (91) to match the end of the leg with the Surface Flow Tree (70);

i. assembling the Flexitube (101) on the Surface Flow Tree (70) and surface lines (105 and 106);

j. carrying out the operation of clearing the leg (14) of the submarine pipe (40) with the Flexitube (101);

k cleaning the leg (14) of the submarine pipe (40) with high flow rate seawater circulation;

l. Disassembling the Flexitube (101), the surface lines (105 and 106) and the Surface Flow Tree (70) pieces of equipment;

m. installing the pull head (16) at the end of the leg (14) of the cleared submarine pipe (40), assembling the hoisting assembly (58) for hoisting the leg (14) of the submarine pipe (40) with the drill string (50), and descending the leg (14) of the submarine pipe (40) to the seabed, where the leg (12) of the submarine pipe (40) is located;

n. removing the pull heads (16 and 17) from the legs (12 and 14) of the submarine pipe (40) and connecting the legs (12 and 14) via the flanged connection (10).

2. The method according to claim 1, wherein the step of opening the flanged connection (10) and installing the pull heads (16 and 17) is performed by an ROV.

3. The method according to claim 1, wherein the attachment of floats (18 and 19) in each of the legs (12 and 14) makes each leg (12 and 14) have a curved section towards the surface.

4. The method according to claim 3, wherein the curved section is a hump.

5. The method according to claim 1, wherein the hoisting assembly (58) comprises an inverted drill pipe elevator (52) attached to the drill string (50), and, attached to the inverted drill pipe elevator (52), there are anchor ties (54) comprising the hook (56).

* * * * *